US012102193B2

(12) United States Patent
Tanokura et al.

(10) Patent No.: US 12,102,193 B2
(45) Date of Patent: Oct. 1, 2024

(54) MESH HOOK SURFACE FASTENER, PRODUCTION METHOD THEREFOR, AND PRODUCTION METHOD FOR SURFACE FASTENER-ATTACHED MOLDED BODY

(71) Applicants: KURARAY FASTENING CO., LTD., Osaka (JP); DELTA KOGYO CO., LTD., Hiroshima (JP)

(72) Inventors: Toru Tanokura, Osaka (JP); Yoshikatsu Fujisawa, Sakai (JP); Satoru Ono, Sakai (JP); Etsunori Fujita, Hiroshima (JP)

(73) Assignees: KURARAY FASTENING CO., LTD., Osaka (JP); DELTA KOGYO CO., LTD., Hiroshima (JP)

( * ) Notice: Subject to any disclaimer, the term of this patent is extended or adjusted under 35 U.S.C. 154(b) by 281 days.

(21) Appl. No.: 17/755,061

(22) PCT Filed: Oct. 22, 2020

(86) PCT No.: PCT/JP2020/039698
§ 371 (c)(1),
(2) Date: Apr. 20, 2022

(87) PCT Pub. No.: WO2021/079928
PCT Pub. Date: Apr. 29, 2021

(65) Prior Publication Data

US 2022/0378156 A1 Dec. 1, 2022

(30) Foreign Application Priority Data

Oct. 22, 2019 (JP) ..... 2019-192372

(51) Int. Cl.
*A44B 18/00* (2006.01)
*A47C 7/02* (2006.01)

(52) U.S. Cl.
CPC ..... *A44B 18/0019* (2013.01); *A47C 7/0213* (2018.08)

(58) Field of Classification Search
CPC ..... A44B 18/0019; A47C 7/0213
See application file for complete search history.

(56) References Cited

U.S. PATENT DOCUMENTS 4,454,183 A * 6/1984 Wollman ..... A44B 18/0042 428/92
5,688,576 A 11/1997 Ohno et al.
(Continued)

FOREIGN PATENT DOCUMENTS

JP H07-148007 6/1995
JP 2000516482 12/2000
(Continued)

OTHER PUBLICATIONS

International Search Report dated Jan. 12, 2021 In PCT/P2020/039698, with English translation, 5 pages.
(Continued)

*Primary Examiner* — Jason W San
(74) *Attorney, Agent, or Firm* — Grüneberg and Myers PLLC

(57) ABSTRACT

A mesh hook surface fastener does not lose engagement ability even when subjected to mold-in forming and gives only a slight feeling of something foreign. The mesh hook surface fastener contains first shape holding ribs ($a_{21}$) with a relatively small protrusion height and second shape holding ribs ($a_{22}$) with a relatively large protrusion height which protrude to the opposite side of hook-shaped engagement elements ($B_1$, $B_2$) across a base layer ($A_1$) and are alternately arranged. The heights of the adjacent shape holding ribs ($a_{21}$, $a_{22}$) are different, which prevents the direct entrance of a foamable resin liquid and weakens its force. As the force weakens, foaming and curing progress more readily and, as
(Continued)

a result, the amount of the foamable resin liquid that passes through meshes of the base layer to reach the hook-shaped engagement elements can be reduced.

16 Claims, 8 Drawing Sheets

(56) References Cited

U.S. PATENT DOCUMENTS

| | | | | |
|---|---|---|---|---|
| 5,945,193 | A | 8/1999 | Pollard et al. | |
| 5,972,465 | A | 10/1999 | Ohno et al. | |
| 11,730,239 | B2 * | 8/2023 | Takakuwa | B29C 48/0022 24/452 |
| 11,986,063 | B2 * | 5/2024 | Parellada Armela | A44B 18/0011 |
| 2004/0170801 | A1 | 9/2004 | Seth et al. | |
| 2004/0170802 | A1 | 9/2004 | Seth et al. | |
| 2005/0160534 | A1 * | 7/2005 | Akeno | A44B 18/0076 5/652 |
| 2010/0181695 | A1 * | 7/2010 | Murasaki | B29C 43/222 264/176.1 |
| 2011/0030176 | A1 * | 2/2011 | Itoh | A44B 18/0076 264/274 |
| 2014/0130311 | A1 | 5/2014 | Okuda et al. | |
| 2016/0052433 | A1 * | 2/2016 | Ono | B60N 2/5825 24/444 |
| 2021/0100323 | A1 * | 4/2021 | Takakuwa | A44B 18/0076 |
| 2022/0378156 | A1 * | 12/2022 | Tanokura | A44B 18/0076 |

FOREIGN PATENT DOCUMENTS

| | | | |
|---|---|---|---|
| JP | 2006520661 | | 9/2006 |
| JP | 2012011985 | | 1/2012 |
| JP | 4991285 | | 8/2012 |
| JP | 2015192793 | A * | 11/2015 |
| WO | 97/20480 | | 6/1997 |
| WO | 2004/077980 | | 9/2004 |
| WO | 2013/005297 | | 1/2013 |
| WO | 2019/107444 | | 6/2019 |

OTHER PUBLICATIONS

Written Opinion dated Jan. 12, 2021 in PCT/P2020/039698, with English translation, 7 pages.

* cited by examiner

MESH HOOK SURFACE FASTENER, PRODUCTION METHOD THEREFOR, AND PRODUCTION METHOD FOR SURFACE FASTENER-ATTACHED MOLDED BODY

CROSS-REFERENCE TO RELATED APPLICATIONS

This application is the National Stage entry under § 371 of International Application No. PCT/JP2020/039698, filed on Oct. 22, 2020, and which claims the benefit of priority to Japanese Application No. 2019-192372, filed on Oct. 22, 2019. The content of each of these applications is hereby incorporated by reference in its entirety.

BACKGROUND OF THE INVENTION

Technical Field

The present invention relates to a mesh hook surface fastener, a production method therefor, and a production method for a surface fastener-attached molded body integrally including the mesh surface fastener.

Description of Related Art

Conventionally, as a means for attaching a target object to a surface of another object, there has been used a method of fixing a surface fastener having hook-shaped engagement elements (what is called a hook surface fastener) to a surface of one of the target object and the other object and fixing a surface fastener having loop-shaped engagement elements (what is called a loop surface fastener) to a surface of the other, and laying engagement element surfaces of these surface fasteners on each other to engage their engagement elements, thereby fixing the target object to the surface of the other object.

In recent years, for forming a seat structure of automobiles and airplanes, widely used is a method of injecting a foamable resin liquid of polyurethane or the like into a seat-shaped mold, molding the foamable resin liquid into the seat shape simultaneously with foaming, then fixing a hook surface fastener to a predetermined place of a front surface of a foamed resin molded body (cushioning member) molded into the seat shape, attaching a loop surface fastener to the rear surface of an outer layer member that is to cover the surface of the foamed resin molded body, and covering the surface of the foamed resin molded body with the outer layer member while laying the hook surface fastener and the loop surface fastener on each other to engage them, thereby fixing the outer layer member to the surface of the foamed resin molded body. It is also done to form a groove in the surface of the foamed molded body at a place where to fix the hook surface fastener and fix the hook surface fastener in the groove, thereby reducing a feeling of something foreign due to the hook surface fastener as much as possible.

As a method for fixing the hook surface fastener to the surface of the foamed resin molded body, there is widely used a method of fixing the hook surface fastener to the surface of the foamed resin molded body simultaneously with the molding of the foamed resin molded body instead of pasting the hook surface fastener to the surface of the foamed resin molded body after the molding, specifically, a method called a mold-in forming method of forming a protrusion for forming the aforesaid groove, at a predetermined place in a mold for molding the foamed resin molded body and also providing a recession along an end surface of the protrusion, placing the hook surface fastener in the recession with its engagement element surface facing the bottom surface of the recession (the inner surface of the mold), in this state, injecting the foamable resin liquid into the mold, and fixing the hook surface fastener to the surface of the foamed resin molded body simultaneously with the molding.

What are important in such a mold-in forming method are that the engagement element surfaces of the hook surface fastener are not covered with the foamed resin and that, even if the hook surface fastener is fixed to the surface of the obtained foamed resin molded body, the foamed resin molded body does not have a great difference in flexibility and stretchability between its part covered with the hook surface fastener and its other part not covered with the hook surface fastener.

If the engagement element surfaces of the hook surface fastener are covered with the foamed resin at the time of the molding, the surface fastener loses its engagement ability and the outer layer member cannot be fixed. Even if the foamed resin is tried to be dissolved and removed using a solvent, it is very difficult to remove the foamed resin filled between the engagement elements, and ordinarily, such a hook surface fastener-attached foamed resin molded body is often discarded.

If, in the obtained foamed resin molded body, its part covered with the hook surface fastener is greatly inferior in flexibility and stretchability to its other part not covered therewith, such a seat gives a seated person a feeling of something foreign and is not comfortable to sit.

By using a mold that can make the aforesaid groove in the surface of the foamed molded body for housing the surface fastener deeper so that the surface fastener is attached to the deep part of this deep groove, it may be possible to prevent the seat from giving a feeling of something foreign to a seated person, but attaching the surface fastener to the deep part of such a deep groove necessitates the engagement mate attached to the outer layer member to also reach the deep part of the deep groove, which complicates the structure and necessitates a special device for sufficiently engaging the engagement mate with the hook surface fastener present in the deep part of the deep groove. Therefore, preferably, the groove where to place the surface fastener to be attached to the surface of the foamed resin molded body need not be very deep, that is, the surface fastener has flexibility and stretchability close to those of the foamed resin molded body so that it does not give a feeling of something foreign to a seated person even if the groove is shallow.

Various means have conventionally been contrived to prevent the engagement element surfaces of the hook surface fastener from being covered with the foamed resin at the time of the mold-in forming.

For example, Patent Document 1 describes that, when a hook surface fastener having a region of hook-shaped engagement elements provided upright on the surface of a base is subjected to mold-in forming, the engagement element region is surrounded by a high wall member so that a foamable resin liquid is prevented from entering the engagement element region.

Further, Patent Document 2 describes that, in the case where a hook surface fastener is set in a recession formed along an end surface of a protrusion in a mold, a fitting element capable of sealing a gap between the recession and the hook surface fastener is formed on the rear surface of the hook surface fastener, thereby preventing a foamable resin liquid from entering engagement element surfaces on the front surface side at the time of the molding of the surface fastener.

Indeed, the use of the arts of these prior documents makes it possible to prevent the engagement element surfaces of the hook surface fastener from being covered with the foamed resin, but the high wall member surrounding the engagement element region or the fitting element provided on the base rear surface impairs the flexibility of the hook surface fastener to give a person seated in such a seat a feeling of something foreign, and the presence of the high wall member surrounding the engagement element region lowers the engagement ability of the hook surface fastener.

Patent Document 3, for example, discloses a mesh hook molded surface fastener that includes a first set of a plurality of thermoplastic strands and a second set of a plurality of strands integrally molded with the first set of strands, not present on the same plane as the first set of strands, and intersecting with the first set of strands, wherein at least one of the first set of strands and the second set of strands include hook-shaped engagement elements.

It is also described that such a mesh hook fastener is suitable as a disposable diaper stopper that prevents sweatiness owing to its high breathability.

PRIOR ART DOCUMENT

Patent Document

Patent Document 1: International Patent Publication No. 2013/5297

Patent Document 2: Japanese Patent Application Laid-open No. Hei 07-148007

Patent Document 3: Japanese Patent No. 4991285

SUMMARY OF THE INVENTION

Problems to be Solved by the Invention

Patent Document 3, however, does not describe at all that the mesh hook surface fastener is used in mold-in forming. From common general knowledge, it is easily inferred that, if a surface fastener having a mesh shape is used in mold-in forming, a foamable resin liquid passes through its meshes to enter an engagement element surface side with great force, and hook-shaped engagement elements are covered with a foamed resin to lose their engagement ability. A mesh surface fastener not only has breathability but also has characteristics of easily stretching owing to the elastic function by the deformation of the meshes, and thus being excellent in followability to the movement of an engagement target and not easily giving a feeling of something foreign. Therefore, if its use in the mold-in forming is feasible, the mesh hook fastener is applicable to a part that comes into contact with a person to easily move, such as a cushioning member of a seat structure, and its application range is expected to further widen.

Further, as the resin used for the mesh molded surface fastener, Patent Document 3 only cites non-elastomer thermoplastic resins such as a polyolefin-based resin, polyvinyl chloride, polystyrene, nylon, and polyethylene terephthalate. However, a surface fastener obtained using any of these resins cannot be expected to have required flexibility and stretchability when used for fixing, for example, a cushioning member of a seat structure and an outer layer member.

The present invention was made in consideration of the above and has an object to provide a mesh surface fastener that can be integrated with a foamed resin molded body such as a cushioning member of a seat structure by mold-in forming and can contribute to the widening of its application, a production method therefor, and a production method for a surface fastener-attached molded body.

Means for Solving the Problems

To solve the aforesaid problem, a mesh hook surface fastener of the present invention includes:

- a base layer on whose one surface hook-shaped engagement elements are present and which is formed of a plurality of strands arranged in parallel at intervals; and
- a plurality of shape holding ribs protruding from another surface of the base layer, intersecting with the strands, arranged in parallel at intervals, and integrated with the base layer,
- wherein the shape holding ribs each have: a vertical wall portion extending along a longitudinal direction of the shape holding rib; and a pair of overhanging portions extending toward both sides in terms of a width direction of the vertical wall portion, and adjacent ones of the shape holding ribs have different protrusion heights from the other surface of the base layer.

Preferably, the shape holding ribs include two types which are a first shape holding rib the protrusion height of which is relatively small and a second shape holding rib the protrusion height of which is relatively large, and the first shape holding rib and the second shape holding rib are alternately arranged in an adjacent direction.

Preferably, the protrusion height of the first shape holding rib is 0.4 to 0.8 times the protrusion height of the second shape holding rib.

Preferably, a position of outer end surfaces located opposite to surfaces facing the base layer in the overhanging portions of the first shape holding ribs are closer to the base layer than a position of surfaces facing the base layer in the overhanging portions of the second shape holding ribs.

Preferably, the shortest distance of the overhanging portions of one of the adjacent first shape holding rib and second shape holding rib from the other is 0.2 to 0.6 times a distance between the vertical wall portions of the adjacent first shape holding rib and second shape holding rib along a plane orthogonal to a direction in which the vertical wall portions protrude.

Preferably, a ratio at which the vertical wall portions and the overhanging portions forming the shape holding ribs cover the other surface of the base layer is 60 to 100% of a plane area of the base layer.

Preferably, the mesh hook surface fastener is comprised of a thermoplastic elastomer resin.

More preferably, the thermoplastic elastomer resin is a polyester elastomer or a polyamide elastomer.

Preferably, the hook-shaped engagement elements are each at least one selected from:

- a first engagement element having a stem protruding from the base layer and an engagement portion formed of a protruding piece extending in one direction or both directions along the strands forming the base layer; and
- a second engagement element having a pair of stems protruding from the base layer in a bifurcated manner and engagement portions formed on the pair of stems respectively and shaped to bend more in opposite directions along the strands forming the base layer as the engagement portions go toward tip portions, and wherein the hook-shaped engagement elements are present in a plurality of rows that extend in a direction orthogonal to the strands forming the base layer.

Preferably, the rows of the second engagement elements as the hook-shaped engagement elements are close to side edges of the base layer which are length-direction end edges of the strands, and the row of the first engagement elements as the hook-shaped engagement elements is between the row of the second engagement elements close to one of the side edges and the row of the second engagement elements close to the other side edge.

Preferably, the rows of the hook-shaped engagement elements and the shape holding ribs are symmetrical across the base layer.

Preferably, on the one surface of the base layer, a row composed only of stems without having any engagement portion is present between the adjacent rows of the hook-shaped engagement elements.

Preferably, a water/oil repellent is applied on outer surfaces of the hook-shaped engagement elements and an outer surface of the one surface of the base layer between the adjacent hook-shaped engagement elements.

Preferably, the hook-shaped engagement elements are covered with a fiber sheet having loop-shaped engagement elements and not coated with a water/oil repellent.

A production method for a mesh hook fastener of the present invention includes:

charging a molding material into an extruder including an extrusion nozzle, and extruding a tape-shaped object from the extrusion nozzle, the extrusion nozzle having a laterally long slit having a predetermined width in a direction orthogonal to an extrusion direction, upward protruding space portions extending upward from the laterally long slit and arranged at predetermined intervals in a width direction of the laterally long slit, and downward protruding space portions extending downward from the laterally long slit and arranged at intervals in the width direction of the laterally long slit, with adjacent ones of the downward protruding space portions being different in an amount of the downward protrusion from the laterally long slit;

making incisions at predetermined intervals in the extrusion direction, the incisions each extending in a direction intersecting with the extrusion direction and each being made from tops of portions extruded from the upward protruding space portions up to another surface of a portion extruded from the laterally long slit; and thereafter drawing the tape-shaped object in the extrusion direction, thereby making the portion extruded from the laterally long slit into a base layer in which strands are arranged in parallel, making the portions extruded from the upward protruding space portions into hook-shaped engagement elements protruding from one surface of the base layer, and making portions extruded from the downward protruding space portions into shape holding ribs protruding from another surface of the base layer, with adjacent ones of the shape holding ribs being different in protrusion height from the other surface of the base layer.

A manufacturing method for a surface fastener-attached molded body of the present invention includes:

attaching any one of the above-described mesh surface fasteners in a forming mold with the hook-shaped engagement elements facing an inner surface of the forming mold;

next injecting a foamable resin liquid into the forming mold, bringing the foamable resin liquid into contact with the mesh hook surface fastener from the shape holding rib side, and foaming and curing the foamable resin liquid; and thereafter taking out the resultant from the forming mold to obtain a foamed resin molded body integrated with the mesh hook surface fastener.

Preferably, the foamed resin molded body is employed as a cushioning member of a seat structure.

Effect of the Invention

In the mesh hook surface fastener of the present invention, out of the shape holding ribs protruding opposite to the hook-shaped engagement elements across the base layer, the adjacent ones have different protrusion heights. Preferably, the first shape holding ribs having a relatively small protrusion height and the second shape holding ribs having a relatively large protrusion height are alternately arranged.

In the case where a foamable resin liquid is injected in the state in which a mesh hook surface fastener is set in a mold with its hook-shaped engagement elements facing the inner surface of the mold, in a conventional mesh hook surface fastener whose adjacent shape holding ribs have the same protrusion height, the foamable resin liquid having passed through gaps between the adjacent shape holding ribs directly reaches meshes of a base layer with great force without any barrier and further tries to pass through up to hook-shaped engagement elements side. In the present invention, on the other hand, since the protrusion heights of the adjacent shape holding ribs are different as described above, the foamable resin liquid, when reaching, for example, the overhanging portions of the first shape holding ribs whose protrusion height from the base layer is small, branches off to the left and right there, and the branching foamable resin liquid hits against the side surfaces of the vertical wall portions of the second shape holding ribs whose protrusion height from the base layer is large, and thus is prevented from straightly entering the hook-shaped engagement elements and reduces in its force. When its force weakens, its foaming and curing readily progress, resulting in a reduction in the amount of the foamable resin liquid passing through the meshes of the base layer to reach the hook-shaped engagement elements.

Therefore, the mesh hook surface fastener of the present invention can be integrated with the foamed resin molded body with almost no engagement ability lost even if the mold-in forming is employed. Therefore, it is suitable for being integrated with a molded body that comes into contact with a person to easily move, such as a cushioning member of a seat structure, which can contribute to the wider application of the mesh hook surface fastener.

In the mesh hook surface fastener of the present invention, by applying the water/oil repellent on the hook-shaped engagement elements side, it is possible to further reduce the adhesion of the foamed resin to the hook-shaped engagement elements side after the molding. Further, even if the foamed resin having passed through the meshes and cured between the hook-shaped engagement elements is present, by covering the mesh hook surface fastener with the fiber sheet having the loop-shaped engagement elements and peeling this fiber sheet after the molding, it is possible to easily remove the foamed resin in the state of adhering to the fiber sheet, enabling a further increase in the engagement ability.

Further, the mesh hook surface fastener of the present invention is preferably formed of a thermoplastic elastomer. Because the thermoplastic elastomer has very excellent flexibility and stretchability, the foamed resin molded body to which such a mesh hook surface fastener is attached does not have a great difference in flexibility and stretchability between its part where the surface fastener is attached and its other part where the surface fastener is not attached, and gives less feeling of something foreign ascribable to the surface fastener.

DETAILED DESCRIPTION OF THE INVENTION

Modes for Carrying Out the Invention

Figure 1:
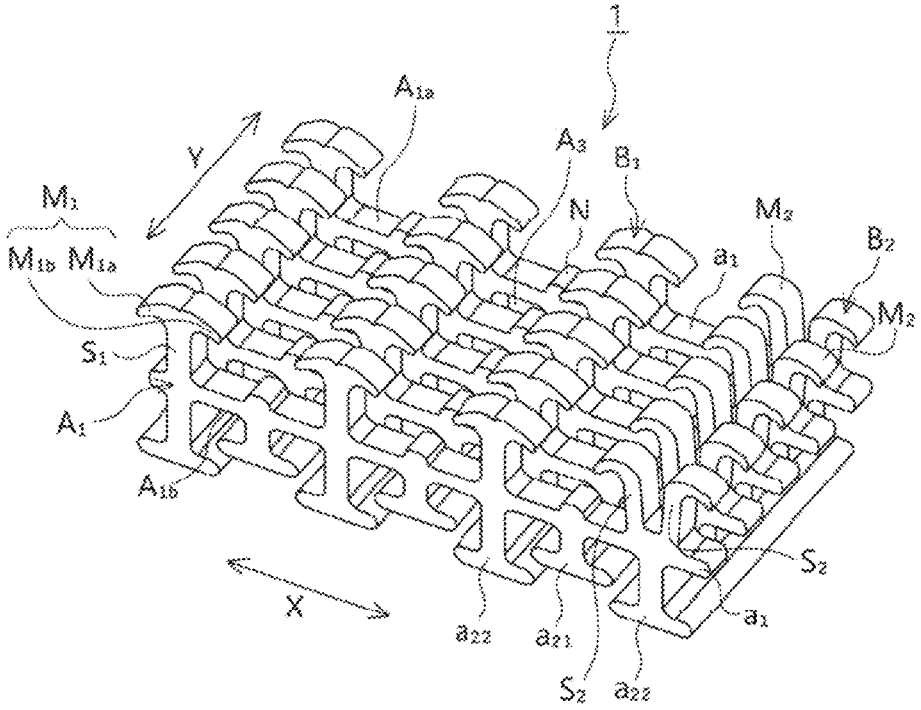
FIG. 1 is a partial perspective view schematically illustrating an example of a mesh hook surface fastener of the present invention.

An embodiment of a mesh hook surface fastener of the present invention will be hereinafter described in detail based on the drawings. As illustrated in FIG. 1, the mesh hook surface fastener (1) of this embodiment includes: a base layer ($A_1$) including a plurality of strands ($a_1$) arranged in parallel at intervals; hook-shaped engagement elements ($B_1$, $B_2$) provided on one surface ($A_{1a}$) of the base layer ($A_1$); and a plurality of shape holding ribs ($a_{21}$, $a_{22}$) protruding from the other surface ($A_{1b}$) of the base layer ($A_1$), intersecting with the strands ($a_1$), and arranged in parallel at intervals.

As is seen from FIG. 1, the hook-shaped engagement elements ($B_1$, $B_2$) all rise substantially vertically or obliquely from the one surface ($A_{1a}$) of the base layer ($A_1$) (more correctly, one-side surfaces of the strands ($a_1$) forming the base layer ($A_1$)). Further, the hook-shaped engagement elements ($B_1$, $B_2$) are arranged at predetermined intervals in the same direction as the length direction of the shape holding ribs [($a_{21}$, ($a_{22}$)] present on the other surface ($A_{1b}$) of the base layer ($A_1$) to form rows.

The hook-shaped engagement elements in this embodiment include first engagement elements ($B_1$) and second engagement elements ($B_2$). The first engagement elements ($B_1$) each have a stem ($S_1$) extending from a root (the one surface ($A_{1a}$) of the base layer ($A_1$) (more correctly, the one surface of the strand ($a_1$)) and an engagement portion ($M_1$) composed of a pair of protruding pieces ($M_{1a}$, $M_{1b}$) extending from the middle or top of the stem ($S_1$) in both directions along the length direction of the strand ($a_1$). As illustrated in the right side edge in FIG. 1, the second engagement elements ($B_2$) each have: a pair of stems ($S_2$, $S_2$) protruding in a bifurcated manner from the one surface ($A_{1a}$) of the base layer ($A_1$) (more correctly, the one surface of the strand ($a_1$)); and engagement portions ($M_2$, $M_2$) shaped such that they bend more in opposite directions along the strand ($a_1$) from the pair of stems ($S_2$, $S_2$) as they go toward tip portions and their extreme tips approach the one surface ($A_{1a}$) of the base layer ($A_1$).

Though the protruding pieces ($M_{1a}$, $M_{1b}$) forming the engagement portion ($M_1$) of the first engagement element ($B_1$) may protrude from the stem ($S_1$) to both sides as in this embodiment, the engagement portion ($M_1$) may have a protruding piece protruding only to one side, and further the protruding pieces ($M_{1a}$, $M_{1b}$) may protrude in multiple upper and lower tiers. The second engagement elements ($B_2$) may also have the engagement portions ($M_2$) in multiple upper and lower tiers. Further, the hook-shaped engagement elements may include both the first engagement elements ($B_1$) and the second engagement elements ($B_2$) as illustrated in FIG. 1 but may include only either of these. Further, the hook-shaped engagement elements may thus have a typical hook or T shape but besides, may have any shape such as an arrowhead shape and an inverted L-Shape, and what is essential is that the hook-shaped engagement elements have a fastening function of engaging their engagement portions ($M_1$, $M_2$) with loop-shaped engagement element fibers of a loop surface fastener.

However the second engagement elements ($B_2$) are each preferably shaped such that the pair of stems ($S_2$, $S_2$) rise back-to-back from bulging portions present on the one surface ($A_{1a}$) of the base layer ($A_1$), the stems ($S_2$, $S_2$) bend in the opposite directions along the strand ($a_1$) from the middle, and the extreme tips of the engagement portions ($M_2$, $M_2$) approach the one surface ($A_{1a}$) of the base layer ($A_1$). This shape enables the engagement of the loop-shaped engagement elements from whichever direction they approach and makes it difficult for the engagement portions ($M_2$, $M_2$) to be torn off by the engagement.

Preferably, multiple (typically, three to ten) rows of the first engagement elements ($B_1$) are present near the middle of the mesh hook surface fastener (1) in terms of a direction (width direction: the X direction in FIG. 1) perpendicular to the length direction of the shape holding ribs ($a_{21}$, $a_{22}$) (the Y direction in FIG. 1), and near each side edge of the mesh hook surface fastener (1), one row or more (typically, two to five rows) of the second engagement elements ($B_2$) are present. Such co-existence of the first engagement elements ($B_1$) and the second engagement elements ($B_2$) is preferable because, in the case where the mesh hook surface fastener (1) is used for the engagement between, for example, a urethane pad being a cushioning member of a seat structure and an outer layer member, engagement performance therebetween is easily maintained even when torsion or folding occurs.

The plurality of shape holding ribs ($a_{21}$, $a_{22}$) protrude from the other surface ($A_{1b}$) of the base layer ($A_1$), are arranged in parallel at intervals, and intersect with the strands ($a_1$). The strands ($a_1$) and the shape holding ribs ($a_{21}$, $a_{22}$) are integrated at their intersection points, and many meshes ($A_3$) are formed in the base layer ($A_1$), each formed by the two adjacent strands ($a_1$) and the two adjacent shape holding ribs ($a_{21}$, $a_{22}$).

Figure 4:
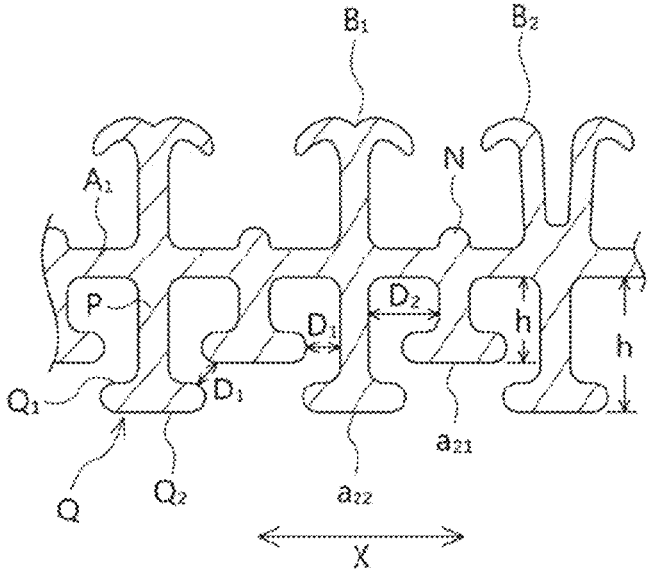
FIG. 4 is a partial sectional view of the example of the mesh hook surface fastener of the present invention taken along a plane perpendicular to the length direction of shape holding ribs.

The shape holding ribs ($a_{21}$, $a_{22}$) each have a vertical wall portion (P) extending along their length direction (the Y direction in FIG. 1) and a pair of overhanging portions (Q) extending to both sides in the width direction (the X direction in FIG. 1) of the vertical wall portion (P). Specifically, as illustrated in FIG. 4, the vertical wall portions (P) protrude from the other surface ($A_{1b}$) of the base layer ($A_1$) and each have a relatively narrow width the cross section along the X direction, and the total width of the pair of overhanging portions (Q) is larger than the width of the vertical wall portion (P). The overhanging portions (Q) protrude to both sides in the width direction at the tips of the vertical wall portions (P) in this embodiment, but can be formed at the middle of the vertical wall portions (P).

Further, as illustrated in FIG. 4, the shape holding ribs ($a_{21}$, $a_{22}$) of this embodiment include two types, namely, first shape holding ribs ($a_{21}$) whose protrusion height (h) from the other surface ($A_{1b}$) of the base layer ($A_1$) is relatively small and second shape holding ribs ($a_{22}$) whose protrusion height (h) is relatively large, and the first shape holding ribs ($a_{21}$) and the second shape holding ribs ($a_{22}$) are alternately arranged in the adjacent direction. Note that the "protrusion height (h)" in this specification is, as illustrated in FIG. 4, a distance from the other surface ($A_{1b}$) of the base layer ($A_1$) up to a point farthest from the other surface ($A_{1b}$), typically, the position of the tip (lowest point), in each of the first shape holding ribs ($a_{21}$) and the second shape holding ribs ($a_{22}$).

Since the shape holding ribs ($a_{21}$, $a_{22}$) have the overhanging portions (Q) protruding outward in the width direction of the vertical wall portions (P), a foamable resin liquid first hits against the overhanging portions (Q) to be prevented from directly entering the base layer ($A_1$) with great force at the time of mold-in forming. Preferably, the first shape holding ribs ($a_{21}$) having a relatively small protrusion height (h) and the second shape holding ribs ($a_{22}$) having a relatively large protrusion height (h) are alternately arranged in the adjacent direction (X direction). Since the protrusion heights (h) of the adjacent shape holding ribs ($a_{21}$, $a_{22}$) are different, that is, the adjacent ones have a level difference, the flow of the foamable resin liquid is hindered at some portion of either of these. For example, the foamable resin liquid is blocked by the overhanging portions (Q) located at the small protrusion height, and the flow of the foamable resin liquid branching off to the left and right hits against the side surfaces of the adjacent vertical wall portions (P) having a large protrusion height. Consequently, the force of the flow of the foamable resin liquid weakens.

As the force of the flow of the foamable resin liquid weakens, the foaming and curing of the foamable resin liquid progress, and accordingly the amount of the foamed resin capable of reaching the base layer ($A_1$) and further passing through the meshes ($A_3$) of the base layer ($A_1$) to reach the vicinity of the hook-shaped engagement elements ($B_1$, $B_2$) is small. Nevertheless, before the molding of the foamed resin, the outer surfaces of the hook-shaped engagement elements ($B_1$, $B_2$) and the one-surface ($A_{1a}$) side outer surface of the base layer ($A_1$) (strands ($a_1$)) are preferably covered with a water/oil repellent. This makes it more difficult for the foamed resin to adhere to the hook-shaped engagement elements ($B_1$, $B_2$), and even if adheres, it can be easily removed. Further, if the hook-shaped engagement elements ($B_1$, $B_2$) are covered with a fiber sheet (not illustrated) having loop-shaped engagement elements before the mesh hook surface fastener (1) is set in a mold in the above-described manner, and the foamable resin liquid is injected, by peeling the fiber sheet after foam molding, it is possible to easily remove the foamed resin adhering to the hook-shaped engagement elements ($B_1$, $B_2$) at a time simultaneously with the peeling of the fiber sheet.

The protrusion height (h) of the first shape holding ribs ($a_{21}$) is preferably 0.4 to 0.8 times the protrusion height (h) of the second shape holding ribs ($a_{22}$). Further, the position of outer end surfaces ($Q_2$) located opposite to surfaces ($Q_1$) facing the base layer ($A_1$) in the overhanging portions (Q) of the first shape holding ribs ($a_{21}$) having a small protrusion height (h) is preferably closer to the base layer ($A_1$) than the position of a surface ($Q_1$) facing the base layer ($A_1$) in the overhanging portions (Q) of the second shape holding ribs ($a_{22}$) having a large protrusion height (h). Further, the shortest distance ($D_1$) of the overhanging portion (Q) of one of the adjacent first shape holding rib ($a_{21}$) and second shape holding rib ($a_{22}$) from the other is preferably 0.2 to 0.6 times a distance ($D_2$) between their vertical wall portions (P) along a plane perpendicular to a direction in which the vertical wall portions (P) protrude. Note that the shortest distance ($D_1$) refers to a distance of a section with the shortest interval from any portion of the overhanging portions (Q) of one of the adjacent first shape holding rib ($a_{21}$) and second shape holding rib ($a_{22}$) up to any portion of the vertical wall portion (P) and the overhanging portion (Q) of the other as illustrated in FIG. 4 and does not refer to only the distance in the direction along the plane orthogonal to the protrusion direction of the vertical wall portion (P) as is referred to by the aforesaid distance ($D_2$).

Setting the relation between the adjacent first shape holding rib ($a_{21}$) and second shape holding rib ($a_{22}$) in this way makes it possible to effectively hinder the aforesaid entrance of the foamable resin liquid toward the hook-shaped engagement elements ($B_1$, $B_2$).

The overhanging portions (Q) of the first shape holding ribs ($a_{21}$) and the second shape holding ribs ($a_{22}$) may be present at the tip portions of the vertical wall portions (P) in one tier as in this embodiment but may be present in two tiers or more in the up-down direction of the vertical wall portions (P).

The transverse sectional shape of the overhanging portions (Q) forming the shape holding ribs ($a_{21}$, $a_{22}$) is not limited to that illustrated in FIG. 1 and may be any of a circle, an oblong circle, an ellipse, a rectangle, and so on, and the sectional shape of the shape holding ribs ($a_{21}$, $a_{22}$) along the plane perpendicular to the length direction may be any of a mushroom shape, an umbrella shape, a T-shape, a Y-shape, an inverted J-shape, an inverted L-shape, and so on.

As for specific dimensions of the mesh hook surface fastener (1) suitable to be integrated with a cushioning member of a seat structure, the protrusion height (h) of the second shape holding ribs ($a_{22}$) is preferably 0.70 to 1.50 mm, and the protrusion height (h) of the first shape holding ribs ($a_{21}$) is preferably 0.30 to 0.60 mm. To prevent the entrance of the foamable resin liquid toward the hook-shaped engagement elements ($B_1$, $B_2$), the protrusion height (h) of the second shape holding ribs ($a_{22}$) is preferably larger than the protrusion height (h) of the first shape holding ribs ($a_{21}$) by 0.15 to 0.40 mm, and the width-direction outward extension length of the overhanging portions (Q) is preferably 0.40 to 1.00 mm for the same reason.

The sectional area of each of the first shape holding ribs ($a_{21}$) and the second shape holding ribs ($a_{22}$) in the plane perpendicular to the length direction is preferably 0.20 to 0.26 $mm^2$, and the sectional area of the overhanging portions (Q) is preferably 20 to 50% of the total sectional area of each of the shape holding ribs ($a_{21}$, $a_{22}$). Such a shape is preferable for obtaining an anchoring effect to the foam-molded body and for preventing the entrance of the foamable resin liquid toward the hook-shaped engagement elements ($B_1$, $B_2$).

Further, to maintain the strength, the number of the shape holding ribs ($a_{21}$,$a_{22}$) arranged in the direction (the X direction in FIG. 1) perpendicular to the drawing direction of the mesh hook surface fastener (1) is preferably five to fifteen per cm.

The shape holding ribs ($a_{21}$, $a_{22}$) are preferably provided such that a ratio at which the vertical wall portions (P) and the overhanging portions (Q) cover the other surface (rear surface) ($A_{1b}$) of the base layer ($A_1$) (rear surface coverage) is 60 to 100% of the plane area of the other surface (rear surface) ($A_{1b}$) of the base layer ($A_1$).

In the case where the overhanging portions (P) protrude to the width-direction both sides from the tip portions of the vertical wall portions (P) as illustrated in FIG. 4, the vertical wall portions (P) are not seen in the rear view and thus the ratio at which the vertical wall portions (P) and the overhanging portions (Q) cover the rear surface (rear surface coverage) mentioned here is an area ratio of the overhanging portions (Q) occupying the rear surface. Further, in the case where the overhanging portions (Q) of the first shape holding ribs ($a_{21}$) having a relatively small protrusion height (h) are partly hidden by the overhanging portions (Q) of the second shape holding ribs ($a_{22}$) having a relatively large protrusion height (h) in the rear view as illustrated in FIG. 4, the aforesaid rear surface coverage is 100%. To find the rear surface coverage, a magnified photograph of the rear surface of the mesh hook surface fastener (1) is taken, and from the photograph, it is possible to easily find the ratio of the area of the shape holding ribs ($a_{21}$, $a_{22}$) to the area of the other surface (rear surface) ($A_{1b}$) of the base layer ($A_1$).

As described above, in the mesh hook surface fastener (1), the strands ($a_1$) forming the base layer ($A_1$) and the shape holding ribs ($a_{21}$, $a_{22}$) extend in different directions, and the strands ($a_1$) are arranged in parallel at intervals and the shape holding ribs ($a_{21}$, $a_{22}$) are also arranged in parallel at intervals. The strands ($a_1$) are on the upper side in the drawings and the shape holding ribs ($a_{21}$, $a_{22}$) are on the lower side in the drawings. Therefore, they are not on the same plane but intersect with and are laid on each other to be integrated, so that the base layer ($A_1$) has a mesh shape having the meshes ($A_3$).

The mesh hook surface fastener (1) has very excellent flexibility and stretchability because it has the mesh shape with the strands ($a_1$) and the shape holding ribs ($a_{21}$, $a_{22}$) not present on the same plane. Therefore, a foamed resin molded body to which the mesh hook surface fastener (1) of this embodiment is attached is excellent inflexibility and stretchability at its part where the mesh hook surface fastener (1) is attached and gives almost no feeling of the presence of the mesh hook surface fastener (1). This eliminates a need for adopting the structure of forming a deep groove in the foamed resin molded body and fixing the surface fastener to the deep part of the groove, to alleviate a feeling of something foreign as is conventionally adopted, and allows the groove to be shallow. This facilitates the work of attaching an outer layer member that is to be fixed to the surface fastener.

The rows of the hook-shaped engagement elements ($B_1$, $B_2$) on the one surface ($A_{1a}$) of the base layer ($A_1$) and the shape holding ribs ($a_{21}$, $a_{22}$) on the other surface ($A_{1b}$) of the base layer ($A_1$) may be present back-to-back symmetrically with the base layer ($A_1$) therebetween, or may be positionally deviated from each other. However, they are preferably present back-to-back from a viewpoint of preventing the hook-shaped engagement elements ($B_1$, $B_2$) from being broken by some factor such as the action of external force pulling them. The back-to-back presence enables to effectively prevent the breakage when the pulling force is applied to the hook-shaped engagement elements ($B_1$, $B_2$) because the roots of the hook-shaped engagement elements ($B_1$, $B_2$) are reinforced in the length direction by the shape holding ribs ($a_{21}$, $a_{22}$) which have been molecular-oriented by the drawing.

Further, the rows of the hook-shaped engagement elements ($B_1$, $B_2$) need not be present on the back-to-back facing surfaces of all the shape holding ribs ($a_{21}$, $a_{22}$), and depending on the size and the number of the engagement elements, a row composed only of stems not having engagement ability (in this embodiment, corresponding to low plateau-shaped bulging portions (N)) may be present as illustrated in FIG. 1 and FIG. 4. Such plateau-shaped bulging portions (N) have an effect of facilitating forming the facing shape holding ribs ($a_{21}$, $a_{22}$) on the rear surface side at the time of the molding. Preferably, as illustrated in FIG. 1 and FIG. 4, the rows of the hook-shaped engagement elements and the rows of the low plateau-shaped bulging portions (N) are alternately present and the low plateau-shaped bulging portions (N) and the low shape holding ribs ($a_{21}$) are present back-to-back.

The mesh hook surface fastener (1) of this embodiment is preferably formed of a thermoplastic elastomer resin. The use of the thermoplastic elastomer resin in combination with the aforesaid mesh shape can make flexibility and stretchability more excellent.

Specific examples of the thermoplastic elastomer resin used include a polyurethane-based resin, a styrene-based elastomer resin, a polyamide elastomer resin, a polyolefin-based elastomer resin, a soft vinyl chloride resin, and a polyester elastomer. Among all, a polyester elastomer and a polyamide elastomer are preferable because the use of either of these more prevents the protruding portions of the engagement elements from being tom off from the stems by being pulled when the engagement is released, than the use of other elastomer resins.

Moreover, a polyester elastomer and a polyamide elastomer are resins having sufficient properties of an elastomer irrespective of having a high modulus of elasticity as compared with other elastomer resins and impart excellent followability to the surface fastener even if its relative movement is caused from various directions, to prevent the easy disengagement from an engagement mate.

In this embodiment, a polyester elastomer that is the most preferable as the thermoplastic elastomer is one in which polyoxytetramethylene glycol is copolymerized with a resin whose main repeating unit is a butylene terephthalate unit and is a resin that has more sufficient properties of an elastic polymer irrespective of having a high modulus of elasticity than other typical elastomer resins, for example, polyurethane, a styrene-based elastomer, an olefin-based elastomer, and so on as described above. Preferably, a ratio of [poly (oxytetramethylene)]terephthalate groups in the polyester elastomer is within a range of 40 to 70 wt %, and more preferably 50 to 60%.

A polyamide elastomer preferable next to the polyester elastomer is an elastomer whose hard segment component is a polyamide block such as a nylon 6 block, a nylon 11 block, or a nylon 12 block and whose soft segment component is polyether such as polyethylene glycol or polytetramethylene glycol, or aliphatic polyether, and that has sufficient properties of an elastic polymer irrespective of having a higher modulus of elasticity than other typical elastomer resins similarly to a polyester elastomer. Preferably, a ratio of the soft segment is 30 to 80 wt %.

The mesh hook surface fastener (1) of this embodiment is most preferably formed of only a polyester elastomer or only a polyamide elastomer, but in the case where a polyester elastomer, a polyamide elastomer, or a mixture of these is used, an elastomer resin other than these, for example, a polyolefin-based elastomer, a styrene-based elastomer, a polyurethane-based elastomer, or the like may be blended, and a small amount of a resin other than the elastomer, for example, a polyolefin-based resin, a polyester-based resin, a polyamide-based resin, a vinyl chloride-based resin, or an ethylene-vinyl alcohol copolymer may be blended.

Besides these, a plasticizer, various stabilizers, a weather-resistant agent, a cross-linking agent, an antibacterial agent, a filler, a flame retardant, an antistatic agent, a reinforcer, a conductive agent, a coloring agent, and so on may be added.

Here, as for the heights of the hook-shaped engagement elements ($B_1$, $B_2$), the first engagement elements ($B_1$) and the second engagement elements ($B_2$) both preferably have a height of 0.80 to 2.00 mm. The density of the hook-shaped engagement elements ($B_1$, $B_2$) is preferably within a range of 30 to 60 pieces/cm$^2$. Further, from a viewpoint of engagement force and the strength of the surface fastener, the number of the rows of such hook-shaped engagement elements ($B_1$, $B_2$) present in the direction perpendicular to the drawing direction of the mesh hook surface fastener (1) is preferably five to fifteen per cm. In the case of the second engagement elements ($B_2$) each having the pair of stems ($S_2$, $S_2$) rising back-to-back and the engagement portions ($M_2$, $M_2$) at the extreme tips of the steins ($S_2$, $S_2$), in counting the density and the number of the rows of the hook-shaped engagement elements ($B_1$, $B_2$) mentioned here, the pair of the back-to-back stems ($S_2$, $S_2$) is counted as one. Further, in FIG. 1, the arrow Y direction is the drawing direction.

As illustrated in FIG. 1, the hook-shaped engagement elements ($B_1$, $B_2$) are composed of the stems ($S_1$, $S_2$) and the engagement portions ($M_1$, $M_2$) extending sideways from the stems ($S_1$, $S_2$) or bending in the side directions, and the engagement portions ($M_1$, $M_2$) stick out from the stems ($S_1$, $S_2$) in the length direction of the strands ($a_1$). Preferably, the engagement portions ($M_1$, $M_2$) do not stick out in any direction other than the length direction of the strands ($a_1$). Further, the engagement portions ($M_1$, $M_2$) preferably have substantially a uniform width from the stems ($S_1$, $S_2$) up to their tips.

Since the stems ($S_1$, $S_2$) and the engagement portions ($M_1$, $M_2$) are coplanar with the strands ($a_1$), their widths are typically equal and are preferably within a range of 0.20 to 0.50 mm from a viewpoint of engagement force and the strength of the surface fastener, and more preferably within a range 0.30 to 0.40 mm.

From a viewpoint of the engagement force and the strength, preferably, the sectional area of each of the stems ($S_1$, $S_2$) of the hook-shaped engagement elements ($B_1$, $B_2$) taken along a plane parallel to the strands ($a_1$) at its middle portion in terms of the height direction is 0.05 to 0.20 mm$^2$, the protrusion length of the engagement portions ($M_1$, $M_2$) from the stems ($S_1$, $S_2$) is 0.30 to 1.00 mm, and an average thickness of the engagement portions ($M_1$, $M_2$) is 0.15 to 0.50 mm.

Further, from a viewpoint of strength and stretchability, preferably, the thickness of the strands ($a_1$) is within a range of 0.10 to 0.40 mm and the adjacent strands ($a_1$) are arranged such that a space having an about 0.20 to 1.00 mm width is formed therebetween.

The mesh hook surface fastener (1) of this embodiment is produced through the sequential execution of the following steps (i) to (iii):

(i) a first step of charging a molding material into an extruder including an extrusion nozzle, and extruding a tape-shaped object from the extrusion nozzle, the extrusion nozzle having a laterally long slit having a predetermined width in a direction orthogonal to an extrusion direction, upward protruding space portions extending upward from the laterally long slit and arranged at predetermined intervals in the width direction of the laterally long slit, and downward protruding space portions extending downward from the laterally long slit and arranged at intervals in the width direction of the laterally long slit, with the adjacent ones being different in an amount of the downward protrusion from the laterally long slit;

(ii) a second step of making incisions at predetermined intervals in the extrusion direction, the incisions each extending along a direction intersecting with the extrusion direction and being made from the tops of portions extruded from the upward protruding space portions up to the other surface of a portion extruded from the laterally long slit; and (iii) a third step of thereafter drawing the tape-shaped object in the extrusion direction.

Figure 2:
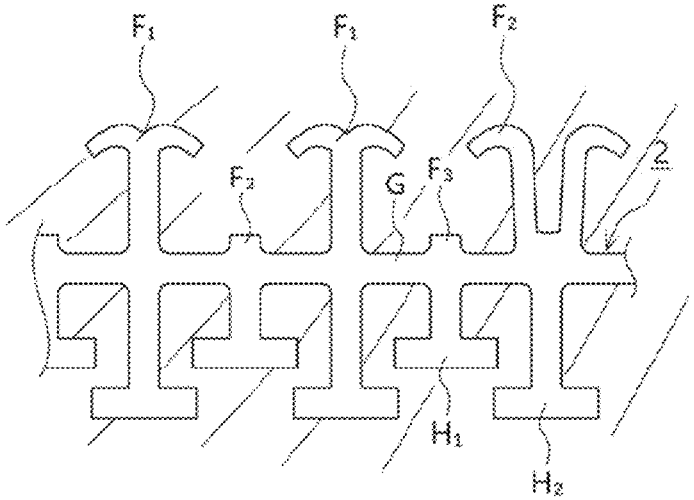
FIG. 2 is a partial sectional view of an example of an extrusion nozzle used for producing the mesh hook surface fastener of the present invention.
Figure 3:
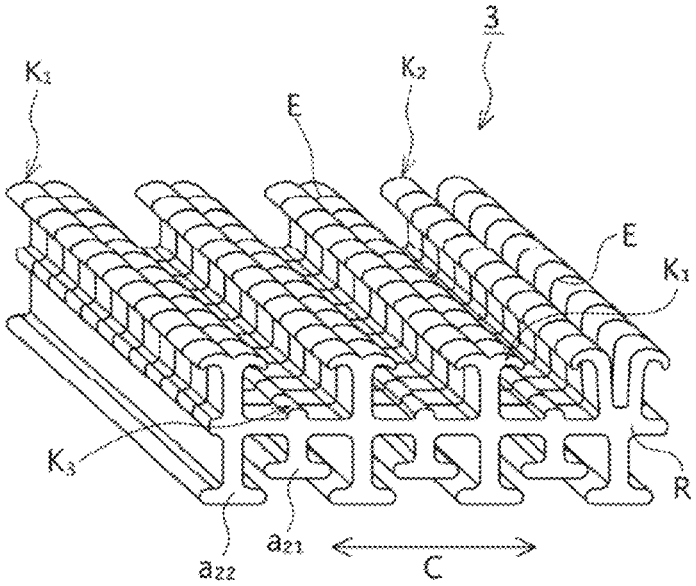
FIG. 3 is a partial perspective view schematically illustrating an extruded molded body (tape-shaped object) at an instant when incisions are made in the molded body, in the middle of the production of the mesh hook surface fastener of the present invention.

In more detail, first, in the first step, a melt of a thermoplastic elastomer resin is extruded from a mold including an extrusion nozzle (2) illustrated in FIG. 2, and the melt is solidified by cooling, whereby a tape-shaped object (3) illustrated in FIG. 3 is obtained. The extrusion nozzle (2) of the mold has a laterally long slit (G) having a predetermined width in the direction orthogonal to the extrusion direction, upward protruding space portions ($F_1$, $F_2$) extending upward from the laterally long slit (G) and arranged at predetermined intervals in the width direction of the laterally long slit (G), and downward protruding space portions ($H_1$, $H_2$) extending downward from the laterally long slit (G) and arranged at predetermined intervals in the width direction of the laterally long slit (G). Out of these, the upward protruding space portions ($F_1$) have a shape corresponding to that of the first engagement elements ($B_1$) out of the hook-shaped engagement elements, and the other upward protruding space portions ($F_2$) have a shape corresponding to that of the second engagement elements ($B_2$) out of the hook-shaped engagement elements. Further, adjacent ones of the downward protruding space portions ($H_1$, $H_2$) have different downward protrusion amounts from the laterally long slit (G).

As illustrated in FIG. 3, the tape-shaped object (3) extruded from the extrusion nozzle (2) illustrated in FIG. 2 has a plurality of rows of ribs ($K_1$, $K_2$) for hook-shaped engagement elements on one surface (front surface) of a sheet portion (R) for base layer which is a portion extruded from the laterally long slit (G), and has a plurality of rows of shape holding ribs ($a_{21}$, $a_{22}$) on the other surface (rear surface) opposite to the one surface. Though incisions (E) are made in the ribs ($K_1$, $K_2$) for hook-shaped engagement elements and in the sheet portion (R) for base layer in FIG.

3, the tape-shaped object (3) does not of course have such incisions (E) at a stage when it is extruded from the extrusion nozzle (2).

In the second step, the incisions (E) extending in the direction (C direction in FIG. 3) intersecting with the extrusion direction of the tape-shaped object (3) are made in the thermoplastic elastomer tape-shaped object (3) extruded from the extrusion nozzle (2), from the tops of the ribs (K) for hook-shaped engagement elements up to the rear surface of the sheet portion (R) for base layer thereunder as illustrated in FIG. 3. The incisions (E) are not made in the shape holding ribs ($a_{21}$, $a_{22}$).

The thickness of the sheet portion (R) for base layer is preferably within a range of 0.10 to 0.40 mm, and especially preferably within a range of 0.20 to 0.30 mm. This thickness scarcely changes even after the drawing is performed. Therefore, this thickness is the thickness of the strands ($a_1$) because the sheet portion (R) for base layer becomes the strands ($a_1$) forming the base layer ($A_1$).

The width of the sheet portion (R) for base layer before the drawing is preferably 10 to 200 mm, and especially preferably 25 to 150 mm. Too wide a width makes it difficult to make the incisions with a uniform depth in the ribs ($K_1$, $K_2$) for hook-shaped engagement elements and the sheet portion (R) for base layer at a high speed.

The incisions (E) made in the ribs ($K_1$, $K_2$) for hook-shaped engagement elements and the sheet portion (R) for base layer are formed in parallel at uniform intervals of, preferably 0.20 to 0.50 mm, and especially preferably 0.30 to 0.40 mm. This interval is the width of the strands ($a_1$) (in FIG. 1, their width along the Y direction) and the width of the hook-shaped engagement elements ($B_1$, $B_2$) (in FIG. 1, their width along the Y direction).

In view of engagement force and so on, the incisions (E) preferably have an angle of 90 to 35 degrees from the length direction (extrusion direction) of the tape-shaped object (3). Particularly preferably, the angle is set such that the strands ($a_1$) and the shape holding ribs ($a_{21}$, $a_{22}$) intersect at angles of 45 to 85 degrees not at right angles after the drawings, from a viewpoint of imparting stretchability in the width direction of the mesh hook surface fastener (1) (the X direction in FIG. 1) and as a result reducing the breakage of the surface fastener due to the force from the engagement elements. In the case where the strands ($a_1$) and the shape holding ribs ($a_{21}$, $a_{22}$) intersect at 45 to 85-degree angles, the meshes ($A_3$) are parallelogram-shaped.

The formation from the thermoplastic elastomer as in this embodiment leads to excellent followability, facilitates making the base layer flat, and facilitates the sure forming of the incisions up to the roots of the shape holding ribs.

In the third step, the tape-shaped object (3) having the incisions (E) is drawn in the extrusion direction (the Y direction in FIG. 1). A stretch ratio is set such that the length of the tape-shaped object having been drawn becomes 1.5 to 2.5 times the total length of the original tape-shaped object (3). As a result of such drawing, the intervals of the incisions (E) widen, the sheet portion (R) for base layer becomes the base layer ($A_1$) where the plurality of independent strands ($a_1$) are arranged in parallel at intervals on the same plane, and the ribs (K) for hook-shaped engagement elements become a large number of the independent hook-shaped engagement elements ($B_1$, $B_2$).

On the other hand, since the incisions are not made in the shape holding ribs ($a_{21}$, $a_{22}$) present on the rear surface of the sheet portion (R) for base layer, the shape holding ribs ($a_{21}$, $a_{22}$) keep the continuous rib shape even after the drawing and function as parts for fixing the strands ($a_1$) and holding the sheet shape of the mesh hook surface fastener (1).

Preferably, the intervals of the incisions (E) become 0.20 to 1.00 mm after the drawing from a viewpoint of the flexibility, followability, and so on of the surface fastener. The shape holding ribs ($a_{21}$, $a_{22}$) are not changed in the sectional shape even by the drawing, but because of the drawing in the length direction, their sectional area reduces while their shape after the drawing is similar to the shape before the drawing. FIG. 1 schematically illustrates the shape of the mesh hook surface fastener (1) after the drawing.

As a result of the third step, the shape holding ribs ($a_{21}$, $a_{22}$) are drawn and molecular-oriented in their length direction while kept continuous. On the other hand, the strands ($a_1$) have almost the same shape as that before the drawing and are not molecular-oriented in the length direction because they are not drawn.

Next, a method for producing a cushioning member used in a seat structure of an automobile, an airplane, or the like, using the mesh hook surface fastener (1) of this embodiment will be described.

First, in the mesh hook surface fastener (1) of the present invention, a water/oil repellent is applied on the outer surfaces of the hook-shaped engagement elements ($B_1$, $B_2$) and the outer surfaces of the strands ($a_1$) on the side where the hook-shaped engagement elements ($B_1$, $B_2$) are present. This can prevent the foamed resin from firmly adhering to the outer surfaces of the hook-shaped engagement elements ($B_1$, $B_2$) even if the foamable resin liquid enters from the rear surface side.

As the water/oil repellent, a generally used one is usable, and its typical examples include a silicon compound-based one, a carbon compound-based one, and a fluorine compound-based one, and among all, a fluorine-based compound is preferable. Examples of the fluorine-based compound include a fluorine-based urethane resin and a fluorine-based acrylic resin.

Next, in the mesh hook surface fastener (1), the hook-shaped engagement elements ($B_1$, $B_2$)-side surface coated with the water/oil repellent (the one surface ($A_{1a}$) of the base layer ($A_1$)) is covered with a fiber sheet that has loop-shaped engagement elements, which are to engage with the hook-shaped engagement elements ($B_1$, $B_2$), and that is not coated with a water/oil repellent. Consequently, when the fiber sheet is removed after the foamed resin molding, the foamed resin having passed through the meshes ($A_3$) of the base layer ($A_1$) from the rear surface side, entered the gaps between the hook-shaped engagement elements ($B_1$, $B_2$), and cured can be very easily removed in the state of adhering to the fiber sheet.

Examples of the fiber sheet include fiber-made sheets, such as a woven fabric, a knitted fabric, and a nonwoven fabric, having, on their surfaces, fibers that are to be loop-shaped engagement elements engageable with the hook-shaped engagement elements ($B_1$, $B_2$). One example thereof is a fabric in which a surface of a tricot knitted fabric which is a ribbed warp knitted fabric having stretchability and thickness is raised with a card clothing or the like, and fibers are pulled out in a loop shape to the surface from the knitted fabric. Another example besides this is a fabric or a nonwoven fabric on whose surface a fiber having loops or crimps engageable with the hook-shaped engagement elements ($B_1$, $B_2$) is present. The fiber sheet is not limited. Such a fiber sheet used is preferably not coated with the water/oil repellent.

Figure 7:
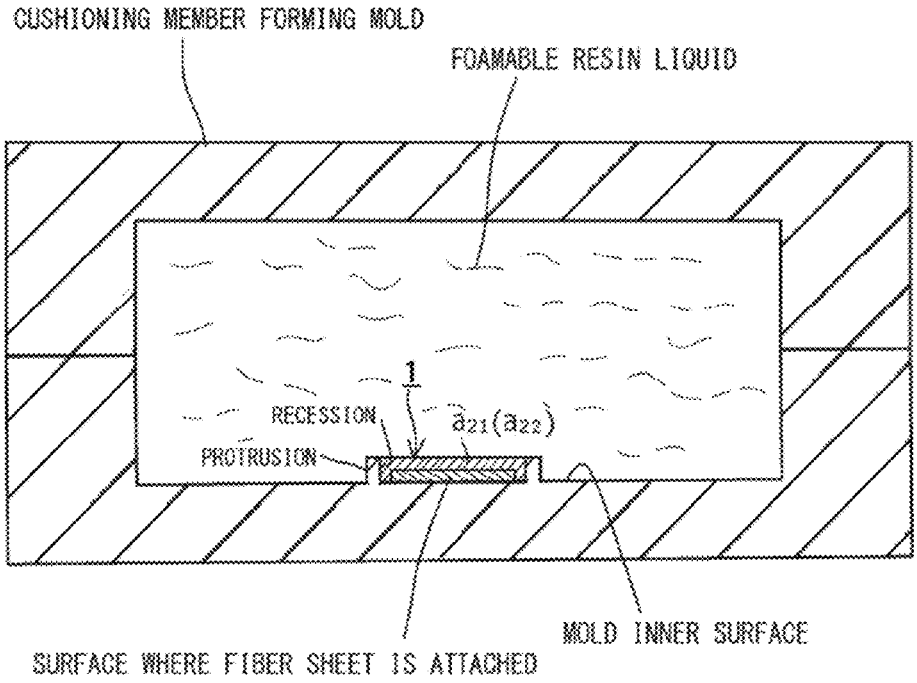
FIG. 7 is an explanatory view of a process of molding a cushioning member while setting the mesh hook surface fastener in a seat cushioning member forming mold.

Next, the mesh hook surface fastener (1) whose hook-shaped engagement elements ($B_1$, $B_2$) are engaged with the fiber sheet is subjected to the mold-in forming Specifically, as illustrated in FIG. 7, in a cushioning member forming mold on whose inner surface a protrusion is provided at a predetermined position, the mesh hook surface fastener (1) is set in a recession formed along an end surface of the protrusion, with the hook-shaped engagement elements ($B_1$, $B_2$)-side surface facing the bottom of the recession (the inner surface of the mold). Next, the foamable resin liquid is injected into the forming mold, and the foamable resin liquid is foamed and cured. Since the injected foamable resin liquid flows while coming into contact with the overhanging portions (Q) and the vertical wall portions (P) of the shape holding ribs ($a_{21}$, $a_{22}$) out of which the adjacent ones have a level difference, the force of the flow of the foamable resin liquid weakens, and the amount of the foamable resin liquid passing through the meshes ($A_3$) to reach the gaps between the hook-shaped engagement elements ($B_1$, $B_2$) reduces. Therefore, in the surface fastener-attached foamed resin molded body taken out from the forming mold, the amount of the foamed resin that has been cured between the hook-shaped engagement elements ($B_1$, $B_2$) is small from the first. Therefore, even if the hook-shaped engagement element sides ($B_1$, $B_2$) are not covered with the fiber sheet, the hook-shaped engagement elements ($B_1$, $B_2$) integrated with the foamed resin molded body are capable of exhibiting certain engagement ability.

However, in this embodiment, since the hook-shaped engagement sides ($B_1$, $B_2$) are covered with the fiber sheet during the molding as described above, the fiber sheet is removed after the foamed resin molded body is taken out from the forming mold. As a result, the foamed resin that has entered the gaps between the hook-shaped engagement elements ($B_1$, $B_2$) is almost completely removed, making it possible to obtain the foamed resin molded body with which the mesh hook surface fastener (1) capable of exhibiting higher engagement ability of the hook-shaped engagement elements ($B_1$, $B_2$) is integrally molded.

An outer layer member made of fabric or leather is attached to thus obtained foamed resin molded body to cover its surface. A loop surface fastener is attached to the outer layer member at a position corresponding to the attachment position of the mesh hook surface fastener (1) and is put on the mesh hook surface fastener (1), thereby engaging the mesh hook surface fastener (1) and the loop surface fastener. Consequently, a seat for an automobile or an airplane, a reception chair, or an office chair to which the outer layer member is firmly fixed is obtained.

Since the mesh hook surface fastener (19) has high flexibility and stretchability, the foamed resin molded body to which the mesh hook surface fastener (1) is attached at a predetermined position does not have a great difference in flexibility and stretchability between its part where the surface fastener is attached and its part where the surface fastener is not attached, and thus gives almost no feeling of something foreign caused by the presence of the surface fastener. Moreover, even though the surface fastener has a mesh shape having the meshes ($A_3$), its engagement ability is not poor because almost no foamed resin enters the gaps between the hook-shaped engagement elements ($B_1$, $B_2$).

The mesh hook surface fastener of the present invention is usable as a mold-in surface fastener when the foamed resin is molded as described above, and besides, is usable in typical mold-in forming using an unfoamable resin. Further, similarly to an ordinary hook surface fastener, it can be of course usable for bonding members in clothing, shoes, hats, rain gear, industrial materials, miscellaneous daily goods, toys, fastening bands, supporters, belts, and so on using its flexibility and stretchability.

EXAMPLES

The present invention will be hereinafter specifically described based on Examples. In Examples, at the time of the measurement of engagement force, surface fasteners are removed from foamed resin molded bodies with care taken not to change the state of engagement element surfaces. As an engagement mate, a loop surface fastener HAT-1548-9 produced by Hatta Tateami Co., Ltd. was used, and as for the engagement force, an initial value of the engagement force was measured as tensile strength (the measurement was conducted according to the method in JIS 13416: 2000 except that an effective width was set to 15 mm). Ten samples were used at the time of the measurement, and an average value in the ten samples was defined as the value of the target surface fastener.

Further, a degree of a feeling of something foreign that the foamed resin molded body to which the surface fastener was attached by mold-in forming gave because of the attachment of the surface fastener to its surface was examined by sensory evaluation, that is, by the touching or pressing of the foamed molded body with a hand.

Example 1

As a resin used for molding, a thermoplastic polyester elastomer (Hytrel, product No. 6377 produced by DU PONT-TORAY CO., LTD.) was used, and this resin was extruded from an extrusion nozzle (2) and immediately put into water to be cooled, to produce a tape-shaped object (3) with a 25 mm width (width along the X direction in FIG. 1) in which ribs (K) for hook-shaped engagement elements were arranged in parallel in the length direction on the front surface a sheet portion (R) for base layer and shape holding ribs ($a_{21}$, $a_{22}$) were arranged in parallel in the length direction on the rear surface of the sheet portion (R) for base layer as illustrated in FIG. 3.

Figure 5:
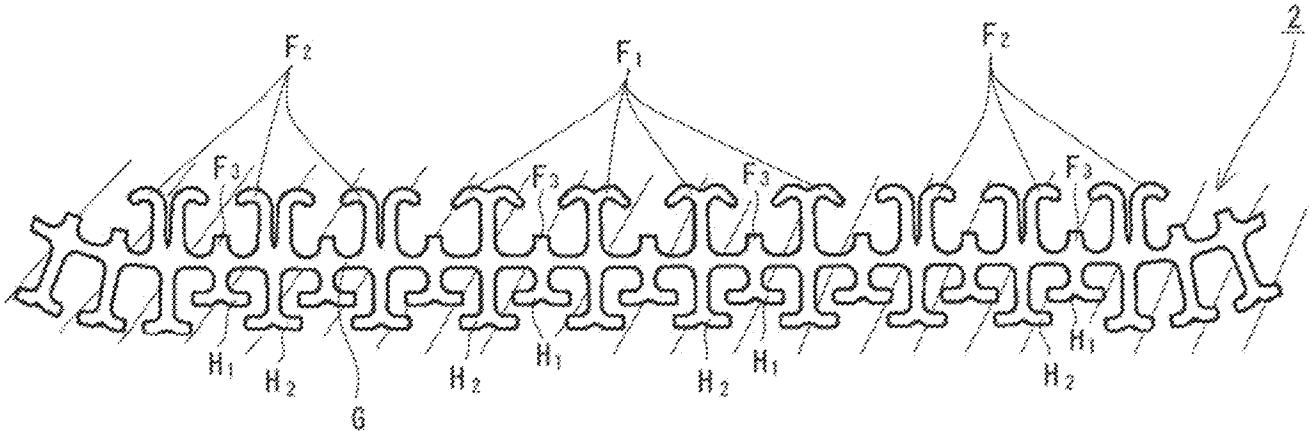
FIG. 5 is a view schematically illustrating a cross section of an extrusion nozzle used in Examples.

The extrusion nozzle (2) of a mold used in this example is illustrated in FIG. 5, and it has: a laterally long slit (G) having a predetermined width in a direction orthogonal to the extrusion direction; three upward protruding space portions ($F_2$) for second engagement elements ($B_2$) at each side of the laterally long slit (G) (the single second engagement element ($B_2$) having a pair of stems is counted as one engagement element); and four upward protruding space portions ($F_1$) for first engagement elements ($B_1$) between the upward protruding space portions ($F_2$, $F_2$) for second engagement elements ($B_2$) present at both sides; and upward protruding space portions ($F_3$) corresponding to low plateau-shaped bulging portions (N) between the adjacent upward protruding space portions ($F_1$, $F_2$) for hook-shaped engagement elements. At positions corresponding to the upward protruding space portions ($F_1$, $F_2$, $F_3$) across the laterally long slit (G), downward protruding space portions ($H_1$) for first shape holding ribs ($a_{21}$) and downward protruding space portions ($H_2$) for second shape holding ribs ($a_{22}$) are arranged alternately in the width direction.

In the tape-shaped object (3), the total number of the ribs ($K_1$, $K_2$) for hook-shaped engagement elements on the front surface was 10/25 mm in the tape width direction (the direction indicated by reference sign W in FIG. 6C), the total number of the ribs for low plateau-shaped bulging portions ($K_3$, see FIG. 3) on the front surface side was 13/25 mm in the tape width direction, and the total number of the shape holding ribs ($a_{21}$, $a_{22}$) on the rear surface side was 23/25 mm in the tape width direction.

Next, as illustrated in FIG. 3, in the tape-shaped object (3) with a 25 mm width, incisions were made at 0.40 mm intervals in the ribs ($K_1$, $K_2$) for hook-shaped engagement elements on the front surface and the sheet portion (R) for base layer, at an angle of 30 degrees from the width direction of the tape-shaped object (3). Incisions were not made in the shape holding ribs ($a_{21}$, $a_{22}$) on the rear surface side. Next, the tape-shaped object (3) having such incisions was drawn to a size twice as long. Consequently, as illustrated in FIG. 1, the ribs ($K_1$, $K_2$) for hook-shaped engagement elements on the front surface became rows of hook-shaped engagement elements ($B_1$, $B_2$), the ribs ($K_3$) for low plateau-shaped bulging portions on the front surface became rows of low plateau-shaped bulging portions (N), and the sheet portion (R) for base layer present in the middle became a base layer ($A_1$) composed of a plurality of strands ($a_1$) with a 25 mm width. On the other hand, the shape holding ribs ($a_{21}$, $a_{22}$) on the rear surface side became shape holding ribs ($a_{21}$, $a_{22}$) which were molecular-oriented in the length direction by the drawing since no incision was made therein.

The obtained mesh surface fastener (1) had a total width of 25 mm (width in the direction indicated by reference sign W in FIG. 6C) and a total thickness of 2.5 mm, and in the mesh surface fastener (1), the base layer ($A_1$) in which the strands ($a_1$) were arranged in parallel at 0.40 mm intervals on the same plane was formed, and the shape holding ribs ($a_{21}$, $a_{22}$) having vertical wall portions (P) and overhanging portions (Q) spreading sideways at the tips of the vertical wall portions (P) in a sectional view were arranged on the same plane in parallel at 0.40 mm intervals.

As the shape holding ribs ($a_{21}$, $a_{22}$), first shape holding ribs ($a_{21}$) with a 0.58 mm protrusion height and second shape holding ribs ($a_{22}$) with a 0.85 mm protrusion height were alternately arranged, and they protruded from the other surface (rear surface ($A_{1b}$) of the base layer ($A_1$)). The shape holding ribs ($a_{21}$, $a_{22}$) intersect with the strands ($a_1$) forming the base layer ($A_1$) at 80 degree-angles, and at their intersection points, the base layer ($A_1$) and the shape holding ribs ($a_{21}$, $a_{22}$) were integrated. Further the hook-shaped engagement elements ($B_1$, $B_2$) with a 1.1 mm height protruded from the front surfaces of the strands ($a_1$) (one surface ($A_{1a}$) of the base layer ($A_1$)) at a density of 51 pieces/cm$^2$.

Therefore, the protrusion height of the first shape holding ribs ($a_{22}$) was about 0.7 times the protrusion height of the second shape holding ribs ($a_{22}$), and the position of outer end surfaces ($Q_2$) of the overhanging portions (Q) of the first shape holding ribs ($a_{21}$) was closer to the other surface (rear surface) ($A_{1b}$) of the base layer ($A_1$) by 0.25 mm than the position of surfaces ($Q_1$), of the second holding ribs ($a_{22}$), facing the base layer ($A_1$). Further, the shortest distance ($D_1$) of the overhanging portions (Q) of either the first shape holding ribs ($a_{21}$) or the second shape holding ribs ($a_{22}$) from the other was 0.36 mm on average, and the overhanging portions (Q) both spread from the vertical wall portions (P) to both sides by 0.68 mm. Further, the rear surface coverage of the shape holding ribs ($a_{21}$, $a_{22}$) occupying the area of the rear surface of the mesh hook surface fastener (1) was 77%, and the aforesaid shortest distance ($D_1$) was 0.35 times the distance ($D_2$) between the vertical wall portions (P) along a plane orthogonal to the protrusion direction.

In each of the first engagement elements ($B_1$) having a T-shaped cross section, its sectional area in a plane parallel to the strand ($a_1$) at a height middle portion was 0.37 mm$^2$, the protrusion length of protruding pieces ($M_{1a}$, $M_{1b}$) forming an engagement portion ($M_1$) from a stem ($S_1$) was 0.26 mm, an average thickness of ($M_1$) was 0.13 mm and the width of the stem ($S_1$) was 0.19 mm. Further, in each of the second engagement elements ($B_2$), its sectional area in a plane parallel to the strand ($a_1$) at a height middle portion of stems ($S_1$, $S_2$) was 0.99 mm$^2$ per stem, the protrusion length of engagement portions ($M_2$, $M_2$) from the stems ($S_2$, $S_2$) was 0.38 mm, an average thickness of the engagement portions ($M_2$, $M_2$) was 0.15 mm, and the width of the stems ($S_2$, $S_2$) was 0.24 mm.

In each of the shape holding ribs ($a_{21}$, $a_{22}$), the width of the overhanging portions (Q) along a plane perpendicular to the length direction was 3.4 times that of the vertical wall portions (P). The sectional shape of the overhanging portions (Q) was an oblong circle as illustrated in FIG. 4, and they both spread from the vertical wall portions (P) to both sides by 0.68 mm. The sectional area of each of the first shape holding ribs ($a_{21}$) along a plane perpendicular to the length direction was 0.20 mm$^2$ and that of each of the second shape holding ribs ($a_{22}$) was 0.26 mm$^2$. The sectional area of the vertical wall portion (P) of the first shape holding rib ($a_{21}$) was 55% of the total sectional area of the first shape holding rib ($a_{21}$), and the sectional area of the vertical wall portion (P) of the second shape holding rib ($a_{22}$) was 69% of the total sectional area of the second shape holding rib ($a_{22}$). Further, the number of such shape holding ribs ($a_{21}$, $a_{22}$) in the direction perpendicular to the drawing direction was 9.2 per cm. Further, the rows of the hook-shaped engagement elements ($B_1$, $B_2$) and the shape holding ribs ($a_{21}$, $a_{22}$) were present back-to-back with the strands ($a_1$) therebetween.

Figure 6A:
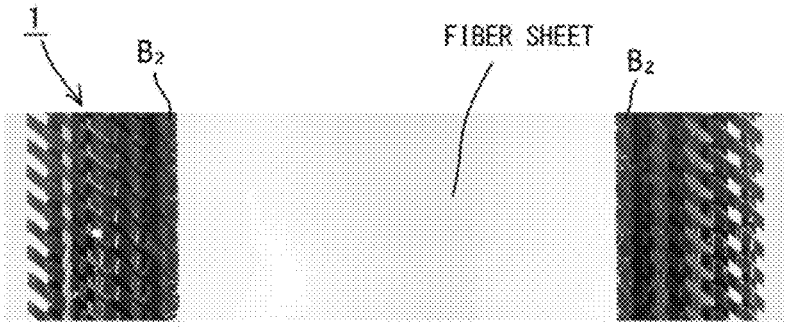
FIG. 6A is a plan view of a process of covering hook-shaped engagement elements with a fiber sheet, seen from a surface where the hook-shaped engagement elements are present.
Figure 6B:
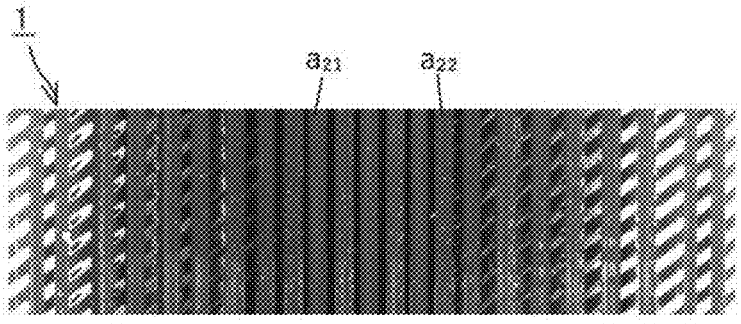
FIG. 6B is a rear view of a process of covering hook-shaped engagement elements with a fiber sheet.
Figure 6C:
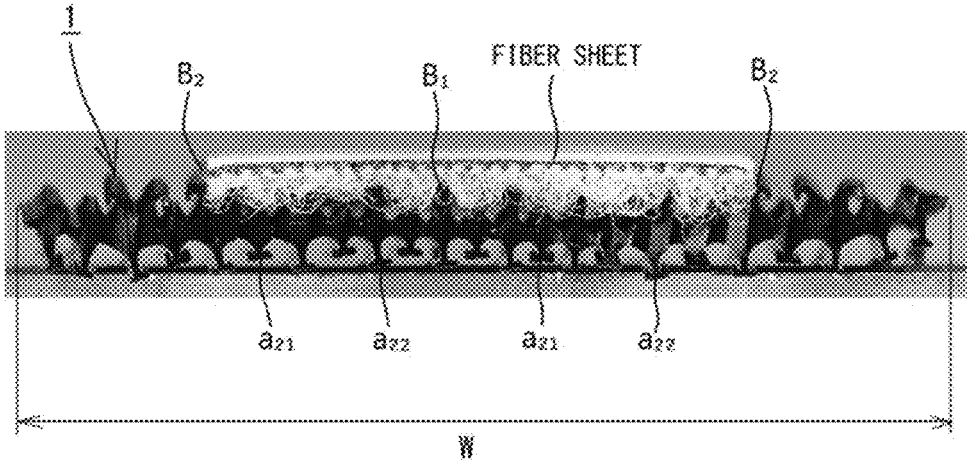
FIG. 6C is a sectional view of a process of covering hook-shaped engagement elements with a fiber sheet.

Next, a fluorine-based water/oil repellent was applied on the outer surfaces of the hook-shaped engagement elements ($B_1$, $B_2$) and the outer surface of the one surface ($A_{1a}$) of the base layer ($A_1$) of the obtained mesh hook surface fastener (1), a loop surface of a fiber sheet having loops on the front surface was laid on the hook-shaped engagement elements ($B_1$, $B_2$) so that the hook-shaped engagement elements ($B_1$, $B_2$) were covered with the fiber sheet as illustrated in FIGS. 6A to 6C. The fiber sheet used was a magnetic body-attached loop surface fastener AP101 produced by APLIX Corporation.

Next, as illustrated in FIG. 7, in a seat cushioning member forming mold in which a protrusion for forming a groove in the surface of a foamed resin molded body after molding was provided at a predetermined position of the inner surface and a recession for housing the mesh hook surface fastener (1) was provided along an end surface of the protrusion, the mesh hook surface fastener (1) was set with the hook-shaped engagement elements ($B_1$, $B_2$) (that is, the surfaces to which the fiber sheet was attached) being on the recession bottom side (a side facing the mold inner surface). Next, a polyurethane-based foamable resin liquid was injected into this cushioning member forming mold, the foamable resin liquid was foamed and cured to produce a surface fastener-attached foamed resin molded body, and the surface fastener-attached foamed resin molded body was taken out from the cushioning member forming mold.

The fiber sheet covering the hook-shaped engagement elements ($B_1$, $B_2$) was removed from the obtained molded body, and the hook-shaped engagement elements ($B_1$, $B_2$) exposed to the molded body surface and the removed fiber sheet were observed. The result showed that there was almost no place where the foamed resin filled the gaps between the hook-shaped engagement elements ($B_1$, $B_2$) due to the flow of the foamable resin liquid toward the hook-shaped engagement elements ($B_1$, $B_2$), the foamed resin entering through meshes ($A_3$) of the base layer ($A_1$) almost entirely adhered to the removed fiber sheet and thus had been removed from the gaps between the hook-shaped engagement elements ($B_1$, $B_2$).

Fifteen engineers engaging in foam molding were requested to participate and evaluate whether or not they had a feeling of something foreign given by the mesh hook surface fastener (1) present on the surface of the obtained surface fastener-attached molded body, by touching or pressing the surface of the molded body with their hands. As a result, owing to the excellent flexibility and stretchability of the surface fastener, they all felt that the presence of the surface fastener did not give a feeling of something foreign, and the obtained surface fastener-attached molded body was a very excellent one that had a completely different touch from that of a conventional foam-molded body to whose surface a surface fastener was fixed.

Figure 8:
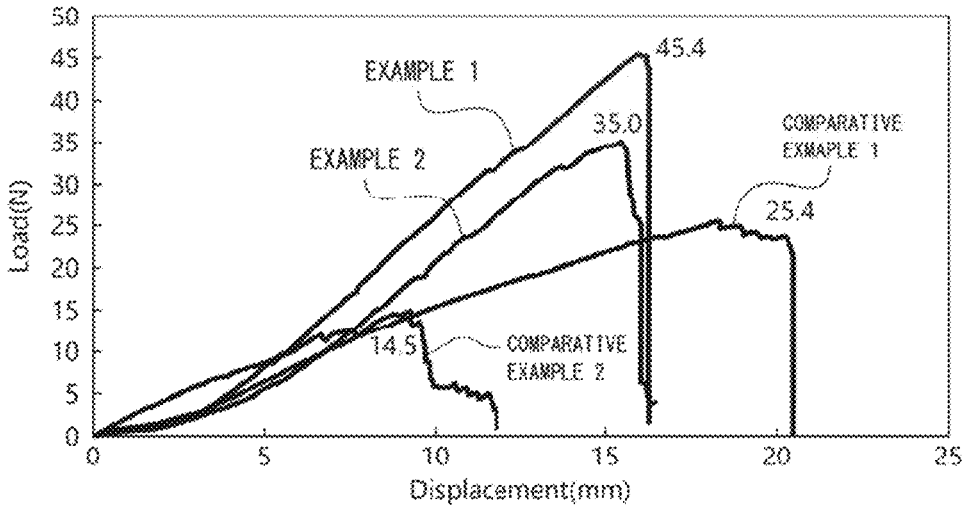
FIG. 8 is a graph illustrating the measurement results of tensile shear strengths of Example 1, Example 2, and Comparative Examples 1 and 2.

Then, the engagement force of the mesh hook surface fastener (1) present on the surface of the hook surface fastener-attached foamed resin molded body was measured. The result showed that its tensile shear strength was 45.4 N, leading to the confirmation that its engagement force was also excellent. FIG. 8 illustrates the measurement results of the tensile shear strengths of Example 1, and later-described Example 2 and Comparative Examples 1 and 2.

Comparative Examples 1, 2

A mesh surface fastener was produced that had, as the shape holding ribs in Example 1 described above, those having the same height as that of the second shape holding ribs ($a_{22}$) having a large protrusion height of Example 1 instead of the two kinds of shape holding ribs ($a_{21}$, $a_{22}$) with different protrusion heights which were alternately arranged as in Example 1. The shape holding ribs were present with the same density as that in Example 1, and their overhanging portions (Q) spread to both sides by 0.36 mm. The other structure is the same as that of Example 1. Then, a water oil repellent was applied on the outer surface on a hook-shaped engagement elements side as in Example 1, and the hook-shaped engagement elements were further covered with the same fiber sheet as that used in Example 1, and mold-in forming was executed similarly to Example 1 to produce a surface fastener-attached foamed resin molded body (Comparative Example 1).

Similarly, a mesh surface fastener was produced that had, as the shape holding ribs in Example 1 described above, those having the same height as that of the first shape holding ribs ($a_{21}$) having a small protrusion height of Example 1. The shape holding ribs were present with the same density as that in Example 1, and their overhanging portions (Q) spread to both sides by 0.36 mm. The other structure is the same as that of Example 1. Then, a water/oil repellent was applied on the outer surface on a hook-shaped engagement elements side as in Example 1, and the hook-shaped engagement elements were covered with the same fiber sheet as that used in Example 1, and mold-in forming was executed similarly to Example 1 to produce a surface fastener-attached foamed resin molded body (Comparative Example 2).

The fiber sheets covering the hook-shaped engagement elements of the foamed resin molded bodies obtained in Comparative Examples 1 and 2 were removed, and the surfaces of the hook-shaped engagement elements of the mesh hook surface fasteners exposed from the molded bodies and the removed fiber sheets were observed. The observation result showed that both in Comparative Example 1 and Comparative Example 2, because of the violent flow of a foamed resin toward the hook-shaped engagement elements of the surface fasteners, gaps between the engagement elements were almost entirely filled with the foamed resin, and though the foamed resin entering from meshes partly adhered to the removed fiber sheets, the foamed resin had not been removed almost at all. The measurement results of the engagement force of the hook surface fasteners present on the surfaces of these hook surface fastener-attached foamed resin molded bodies showed that tensile shear strength in Comparative Example 1 was 25.4 N and tensile shear strength in Comparative Example 2 was 14.5, and thus the engagement forces of both were far inferior to that in Example 1. The reason for this might be that loop-shaped engagement elements of the engagement mate could not enter the inside of the hooks of the hook-shaped engagement elements because the teamed resin was filled between the hook-shaped engagement elements.

Example 2

A mesh hook surface fastener (1) having completely the same size and structure as those of Example 1 was produced. Thereafter, a water/oil repellent was applied on a surface, of the fiber sheet, facing the hook-shaped engagement elements ($B_1$, $B_2$) instead of the outer surfaces of the hook-shaped engagement elements ($B_1$, $B_2$) and the outer surface of the one surface ($A_{1a}$) of the base layer ($A_1$), this fiber sheet was bonded to the hook-shaped engagement elements ($B_1$, $B_2$), and mold-in forming was executed similarly to Example 1 to produce a surface fastener-attached foamed resin molded body.

The fiber sheet covering the hook-shaped engagement elements ($B_1$, $B_2$) of the obtained foamed resin molded body was removed, and the hook-shaped engagement elements ($B_1$, $B_2$) of the mesh hook surface fastener (1) exposed from the surface of the molded body and the removed fiber sheet were observed. The result showed that there was almost no place where gaps between the hook-shaped engagement elements ($B_1$, $B_2$) were filled with a foamed resin due to the flow of a foamable resin liquid, and the foamed resin almost entirely had been removed from the surface of the surface fastener in the state of adhering to the removed fiber sheet as in Example 1.

The measurement result of the engagement force of the mesh hook surface fastener (1) present on the surface of this hook surface fastener-attached foamed resin molded body showed that tensile shear strength was 35.0 N, and thus the mesh hook surface fastener of Example 2 was also excellent as a surface fastener.

However, as a result of conducting tests on whether or not fifteen engineers engaging in foam molding had a feeling of something foreign from the surface of the molded body because of the presence of the hook surface fastener as in Example 1, a small number of (two) engineers answered that they had a feeling of something foreign from the foamed resin molded body because of the presence of the surface fastener. In view of this, Example 2 was slightly inferior to Example 1.

EXPLANATION OF REFERENCE SIGNS

1: mesh hook surface fastener
$A_1$: base layer
$a_1$: strand
$a_{21}$: first shape holding rib
$a_{22}$: second shape holding rib $B_1$: first engagement element (hook-shaped engagement element)

$B_2$: second engagement element (hook-shaped engagement element)

$S_1$, $S_2$: stem $M_1$, $M_2$: engagement portion

2: extrusion nozzle

P: vertical wall portion of shape holding rib

Q: overhanging portion of shape holding rib

E: incision $F_1$, $F_2$, $F_3$: upward protruding space portion

G: laterally long slit $H_1$, $H_2$: downward protruding space portion

3: tape-shaped object $K_1$, $K_2$: rib for hook-shaped engagement element

R: sheet portion for base layer

N: plateau-shaped bulging portion

The invention claimed is:

1. A mesh hook surface fastener, comprising:

a base layer on which hook-shaped engagement elements are arranged on a first surface, and which is formed of a plurality of strands arranged in parallel at intervals; and a plurality of shape holding ribs protruding from a second surface of the base layer, intersecting with the plurality of strands, arranged in parallel at intervals, and integrated with the base layer, wherein each of the plurality of shape holding ribs has:

a vertical wall portion extending along a longitudinal direction of the shape holding rib; and a pair of overhanging portions extending toward both sides of a width direction of the vertical wall portion, and wherein adjacent shape holding ribs have different protrusion heights from the second surface of the base layer.

2. The mesh hook surface fastener according to claim 1, wherein a first type of the plurality of shape holding ribs has a protrusion height which is shorter than a second type of the plurality of shape holding ribs, and wherein the first type of the plurality of shape holding ribs and the second type of the plurality of shape holding ribs are alternately arranged in an adjacent direction.

3. The mesh hook surface fastener according to claim 2, wherein the protrusion height of the first type of the plurality of shape holding ribs is 0.4 to 0.8 times the protrusion height of the second type of the plurality of shape holding ribs.

4. The mesh hook surface fastener according to claim 2, wherein a position of outer end surfaces which are located opposite to surfaces facing the base layer in the overhanging portions of the first type of the plurality of shape holding ribs are closer to the base layer than a position of surfaces facing the base layer in the overhanging portions of the second type of the plurality of shape holding ribs.

5. The mesh hook surface fastener according to claim 2, wherein a shortest distance between the overhanging portion of the first type of the plurality of shape holding ribs and the overhanging portion or the vertical wall portion of the second type of the plurality of shape holding ribs is 0.2 to 0.6 times a distance between the vertical wall portions of the adjacent shape holding ribs along a plane orthogonal to a direction in which the vertical wall portions protrude.

6. The mesh hook surface fastener according to claim 1, wherein a ratio at which the vertical wall portions and the overhanging portions forming the plurality of shape holding ribs cover the second surface of the base layer is 60 to 100% of a plane area of the base layer.

7. The mesh hook surface fastener according to claim 1, wherein the mesh hook surface fastener comprises a thermoplastic elastomer resin.

8. The mesh hook surface fastener according to claim 1, wherein the hook-shaped engagement elements are each at least one selected from the group consisting of:

a first engagement element having a stem protruding from the base layer and an engagement portion formed of a protruding piece extending in one direction or both directions along the plurality of strands forming the base layer; and a second engagement element having a pair of stems protruding from the base layer in a bifurcated manner and with an engagement portion formed on each of the pair of stems which are shaped to bend more in opposite directions along the plurality of strands forming the base layer as the engagement portion goes toward a tip portion, and wherein the hook-shaped engagement elements are arranged in a plurality of rows that extend in a direction orthogonal to the plurality of strands forming the base layer.

9. The mesh hook surface fastener according to claim 8, wherein the plurality of rows of the hook-shaped engagement elements comprises a row of the first engagement elements, a first row of the second engagement elements, and a second row of the second engagement elements, wherein the first row of the second engagement elements is close to a first side edge of the base layer, and the second row of the second engagement elements is close to a second side edge of the base layer, wherein the first side edge and the second side edge are length-direction end edges of the plurality of strands, and wherein the row of the first engagement elements is between the first row of the second engagement elements and the second row of the second engagement elements.

10. The mesh hook surface fastener according to claim 8, wherein the plurality of rows of the hook-shaped engagement elements and the plurality of shape holding ribs are symmetrical across the base layer.

11. The mesh hook surface fastener according to claim 8, wherein, on the first surface of the base layer, a row composed only of stems without any engagement portion is present between adjacent rows of the hook-shaped engagement elements.

12. The mesh hook surface fastener according to claim 1, wherein a water/oil repellent is applied on outer surfaces of the hook-shaped engagement elements and an outer surface of the first surface of the base layer between the adjacent hook-shaped engagement elements.

13. The mesh hook surface fastener according to claim 12, wherein the hook-shaped engagement elements are covered with a fiber sheet having loop-shaped engagement elements which are not coated with the water/oil repellent.

14. A production method for a mesh hook surface fastener, the method comprising:

charging a molding material into an extruder including an extrusion nozzle, and extruding a tape-shaped object from the extrusion nozzle, the extrusion nozzle having:

a laterally long slit having a predetermined width in a direction orthogonal to an extrusion direction, upward protruding space portions extending upward from the laterally long slit and arranged at predetermined intervals in a width direction of the laterally long slit, and downward protruding space portions extending downward from the laterally long slit and arranged at intervals in the width direction of the laterally long slit, with adjacent downward protruding space portions having a different amount of downward protrusion from the laterally long slit;

making incisions at predetermined intervals in the extrusion direction, the incisions each extending in a direction intersecting with the extrusion direction and each being made from tops of portions extruded from the upward protruding space portions up to a portion extruded from the laterally long slit; and drawing the tape-shaped object in the extrusion direction, thereby making the portion extruded from the laterally long slit into a base layer in which strands are arranged in parallel, making the portions extruded from the upward protruding space portions into hook-shaped engagement elements protruding from a first surface of the base layer, and making portions extruded from the downward protruding space portions into shape holding ribs protruding from a second surface of the base layer, with adjacent shape holding ribs being different in protrusion height from the second surface of the base layer.

15. A production method for a surface fastener-attached molded body, the method comprising:

attaching the mesh hook surface fastener according to claim 1 in a forming mold with the hook-shaped engagement elements facing an inner surface of the forming mold;

injecting a foamable resin liquid into the forming mold, bringing the foamable resin liquid into contact with the mesh hook surface fastener from a side of the plurality of shape holding ribs, and foaming and curing the foamable resin liquid; and taking out a foamed resin molded body integrated with the mesh hook surface fastener from the forming mold.

16. The production method for the surface fastener-attached molded body according to claim 15, wherein the foamed resin molded body is a cushioning member of a seat structure.

* * * * *